US008411883B2

(12) United States Patent
Matsumoto

(10) Patent No.: US 8,411,883 B2
(45) Date of Patent: Apr. 2, 2013

(54) LOUDSPEAKER APPARATUS AND SPEAKER SYSTEM

(75) Inventor: Keishi Matsumoto, Hamamatsu (JP)

(73) Assignee: Yamaha Corporation (JP)

( * ) Notice: Subject to any disclaimer, the term of this patent is extended or adjusted under 35 U.S.C. 154(b) by 486 days.

(21) Appl. No.: 12/488,204

(22) Filed: Jun. 19, 2009

(65) Prior Publication Data

US 2009/0316938 A1 Dec. 24, 2009

(30) Foreign Application Priority Data

Jun. 19, 2008 (JP) ..... P. 2008-159985

(51) Int. Cl.
*H04R 5/02* (2006.01)
*H04R 5/00* (2006.01)
*H04R 9/06* (2006.01)

(52) U.S. Cl. ..... 381/303; 381/304; 381/305; 381/300; 381/27; 381/335; 381/336

(58) Field of Classification Search ..... 381/300, 381/303, 304, 59, 335, 336
See application file for complete search history.

(56) References Cited

U.S. PATENT DOCUMENTS

| | | | | |
|---|---|---|---|---|
| 7,920,710 | B2 | 4/2011 | Konagai et al. | |
| 2005/0152557 | A1* | 7/2005 | Sasaki et al. | 381/58 |
| 2006/0153391 | A1* | 7/2006 | Hooley et al. | 381/17 |
| 2007/0019831 | A1 | 1/2007 | Usui | |
| 2007/0161425 | A1* | 7/2007 | Yamaya et al. | 463/35 |
| 2008/0159566 | A1 | 7/2008 | Konagai | |
| 2008/0165979 | A1 | 7/2008 | Takumai | |
| 2011/0013778 | A1 | 1/2011 | Takumai | |

FOREIGN PATENT DOCUMENTS

| | | | |
|---|---|---|---|
| EP | 1760920 | A1 | 3/2007 |
| JP | 2005077912 | A | 3/2005 |
| JP | 2005198049 | A | 7/2005 |
| JP | 2006013711 | A | 1/2006 |
| JP | 2007199322 | A | 8/2007 |
| JP | 2007259088 | | 10/2007 |

OTHER PUBLICATIONS

Japanese Office Action issued in counterpart application No. JP2008-159985, issued Jun. 12, 2012. Partial Eng. translation provided.
Extended European Search Report issued Oct. 4, 2012 for corresponding EP09008084.7.

* cited by examiner

*Primary Examiner* — Yuwen Pan
*Assistant Examiner* — George Monikang
(74) *Attorney, Agent, or Firm* — Rossi, Kimms & McDowell LLC

(57) ABSTRACT

A loudspeaker apparatus includes a speaker array that has a plurality of speaker units which are arranged on a sound emitting surface of the speaker array, and emits sound beams on a plurality of channels, an angle sensing section that senses an angle change displaced from a previously set reference angle of the sound emitting surface, and an adjusting section that adjusts output angles of the sound beams in response to the angle change.

8 Claims, 12 Drawing Sheets

FIG. 5

| ANGLE CHANGE | AMOUNT OF DELAY OF SPEAKER UNIT 161 | AMOUNT OF DELAY OF SPEAKER UNIT 162 | ··· | AMOUNT OF DELAY OF SPEAKER UNIT 168 |
|---|---|---|---|---|
| -45 | 8 | 17 | ··· | 38 |
| -40 | 7 | 16 | ··· | 35 |
| ⋮ | ⋮ | ⋮ | ⋮ | ⋮ |
| 0 | 2 | 11 | ··· | 20 |
| 5 | 2 | 10 | ··· | 17 |
| 10 | 1 | 9 | ··· | 14 |
| ⋮ | ⋮ | ⋮ | ⋮ | ⋮ |
| 45 | 0 | 5 | 0 | 2 |

$$\beta = \tan^{-1}\{(2a - L\sin\theta)/L\cos\theta\}$$

$$\beta = \tan^{-1}\{(2a - L\sin\theta)/L\}$$

LOUDSPEAKER APPARATUS AND SPEAKER SYSTEM

BACKGROUND

The present invention relates to a loudspeaker apparatus equipped with a speaker array that outputs sound beams and a speaker system.

Conventionally, the speaker array that shapes the sound in beams to output the sound beams has been known. As shown in FIG. 1A, it has been proposed that sound beams generated by using this speaker array are reflected at wall surfaces such that multi-channel surround sounds on respective channels are reached to the listener (user) from the back side, or the like (see US2007/0019831A1, for example).

In order to cause the sound beams on respective channels to reflect on the wall surfaces and then reach the user, output angles of the sound beams must be adjusted in response to a set-up position of the speaker array and a listening position of the user. Therefore, such an approach has been proposed that the output angles are automatically set by setting up a microphone at the listening position, then sweeping the sound beams, and then sensing angles of the incoming sound beams at the listener on the basis of sound levels of picked up sounds (see US2008/0165979A1, for example).

However, as shown in FIG. 1B, when the set-up direction of the speaker array is changed, e.g., the user comes in touch with the speaker array, or the like, respective angles of the sound beams to the wall surfaces are changed and thus the sound beams do not reach the listening position.

Also, in case the speaker array being integrated with the television that can turn horizontally or vertically is used, the speaker array is also turned along with a turn of the television. Therefore, as also shown in FIG. 1R, the sound beams do not reach the listening position.

If measurement recited as in the equipment in US2008/0165979A1 is performed every time the set-up direction of the speaker array is changed, such measurement is very troublesome to the user.

SUMMARY

Therefore, it is an object of the present invention to provide a loudspeaker apparatus capable of emitting sound beams so as to reach the listening position even when a direction of the speaker array is changed from a reference set-up direction and a speaker system equipped with the loudspeaker apparatus.

In order to achieve the above object, according to the present invention, there is provided a loudspeaker apparatus, comprising:

a speaker array that has a plurality of speaker units which are arranged on a sound emitting surface of the speaker array, and emits-sound beams on a plurality of channels;

an angle sensing section that senses an angle change displaced from a previously set reference angle of the sound emitting surface; and an adjusting section that adjusts output angles of the sound beams in response to the angle change.

In this manner, the angle sensing section is provided to sense the angle change (for example, change in the set-up direction) from the previously set reference angle (for example, reference surface), and the output angles of the sound beams are adjusted. Therefore, even when the set-up direction of the loudspeaker apparatus is changed, the sound beams can be reached the listening position.

Preferably, the adjusting section adjusts the output angles of the sound beams except a sound beam on a center channel among the sound beams on the plurality of channels.

Even when the set-up direction of the loudspeaker apparatus is changed, there is no necessity that the output angle on the center channel is adjusted if the user moves in that direction and the relative positional relationship is not changed. Therefore, in this case, the sound beams are adjusted other than the sound beam on the center channel.

Preferably, the adjusting section adjusts the output angles of the sound beams on all of the plurality of channels including the center channel when the angle change is smaller than a predetermined degree. Also, the adjusting section adjusts the output angles of the sound beams except the sound beam on the center channel when the angle change is in excess of the predetermined degree.

Preferably, the adjusting section adjusts the output angles of the sound beams in at least one of a horizontal direction and a vertical direction.

In this case, the sound beams are changed (tilted) in the vertical direction. For example, when the loudspeaker apparatus is mounted to the appliance whose angle is also changed in the vertical direction, e.g., a wall mount of a slim television, or the like, the sound beams can be reached the listening position.

Preferably, the loudspeaker apparatus further includes a storage section that stores information regarding delay amounts of sound signals with respect to angle changes displaced from the previously set reference angle of the sound emitting surface. The delay amount corresponding to the angle change sensed by the angle sensing section is read from the storage section. The adjusting section sets the delay amount read from the storage section to the speaker units to adjust the output angles of the sound beams.

Preferably, an angle of the sound emitting surface at a time of receiving information regarding an interior shape of a room and a set-up position of the loudspeaker apparatus in the room is set as the reference angle.

Preferably, an angle of the sound emitting surface at a time of measuring a shape of an interior of a room and a relationship between a listening position and the loudspeaker apparatus by sweeping a test sound beam is set as the reference angle.

According to the present invention, there is also provided a speaker system, comprising:

a loudspeaker apparatus; and a display apparatus integrally constructed with the loudspeaker apparatus, wherein the loudspeaker apparatus includes:

a speaker array that has a plurality of speaker units which are arranged on a sound emitting surface of the speaker array, and emits sound beams on a plurality of channels; and an adjusting section that adjusts output angles of the sound beams in response to an angle change displaced from a previously set reference angle of the sound emitting surface; and wherein an angle sensing section, which senses the angle change, is provided at least one of the loudspeaker apparatus and the display apparatus.

According to the above configurations, the output angles of the sound beams are adjusted by providing the angle sensing section, and then sensing a change of angle from a reference surface (change of the setting-up direction). Therefore, even when the set-up direction of the speaker array is changed, the sound beams can be reached the listening position.

BRIEF DESCRIPTION OF THE DRAWINGS

The above objects and advantages of the present invention will become more apparent by describing in detail preferred exemplary embodiments thereof with reference to the accompanying drawings, wherein:

FIG. 5 is a table showing a relationship between an angle change and an amount of delay being set to each loudspeaker apparatus;

DETAILED DESCRIPTION OF EXEMPLARY EMBODIMENTS

Figure 1A:
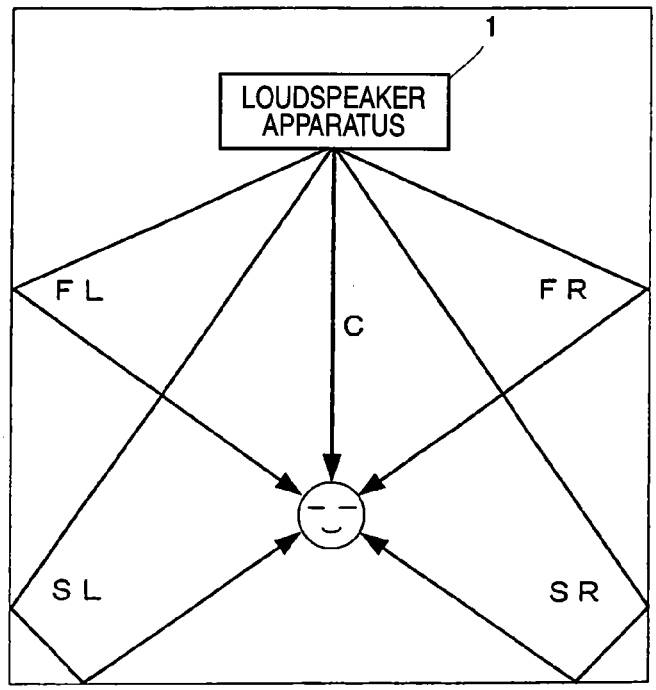
FIGS. 1A and 1B are views showing paths of sound beams.
Figure 1B:
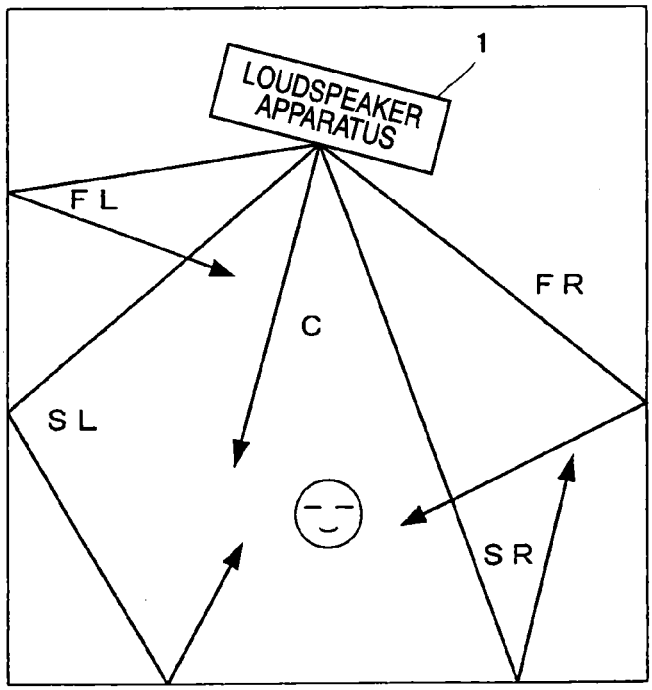
Figure 2A:
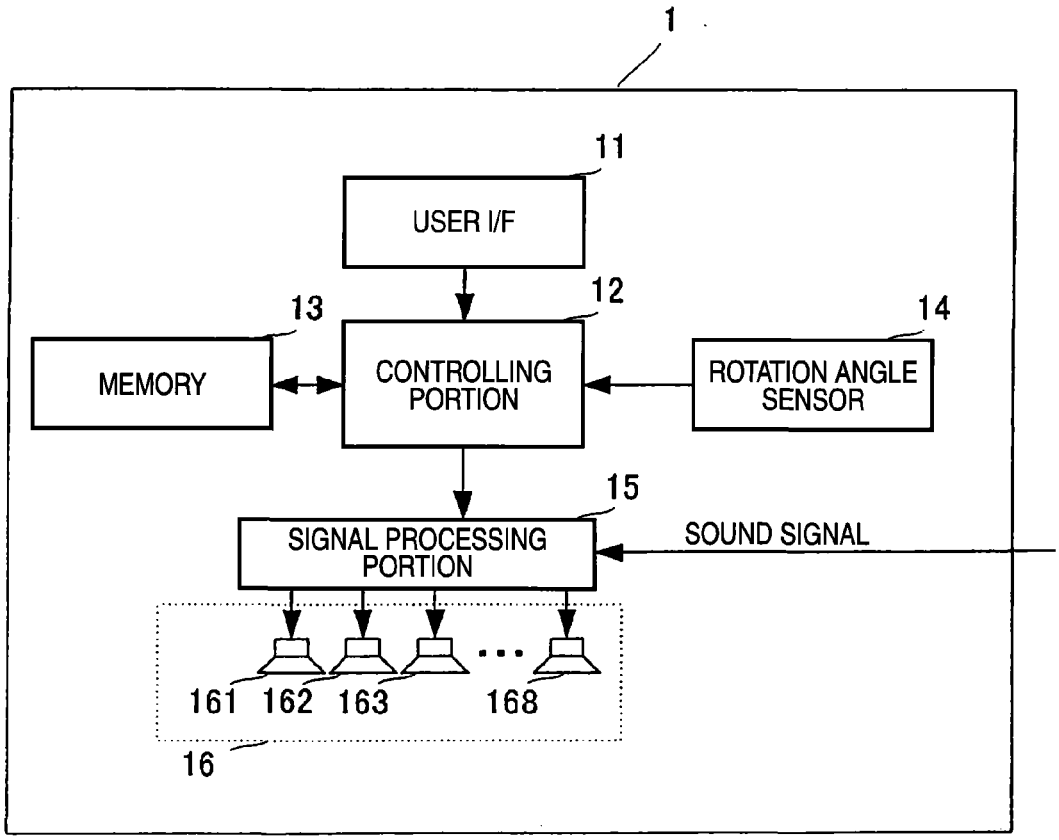
FIG. 2A is a block diagram showing a configuration of a loudspeaker apparatus and FIG. 2B is an external view showing an appearance of the loudspeaker apparatus.

A loudspeaker apparatus according to an embodiment of the present invention will be explained hereunder. FIG. 2A is a block diagram showing a configuration of a loudspeaker apparatus of the embodiment, and FIG. 2B is an external view showing the loudspeaker apparatus.

Figure 2B:
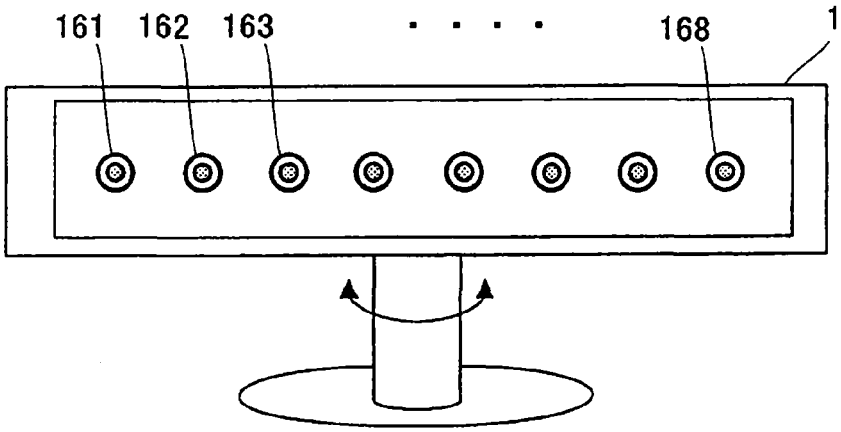

As shown in FIG. 2B, a loudspeaker apparatus 1 is rotated by a predetermined angle (e.g., ±45 degree) in the horizontal direction from a reference direction, and adjusts output angles of the sound beams in response to the rotation angle.

As shown in FIG. 2A, the loudspeaker apparatus 1 includes a user I/F 11, a controlling portion 12, a memory 13, a rotation angle sensor 14, a signal processing portion 15, and a speaker array 16 (speaker units 161 to 168). The user I/F 11, the memory 13, the rotation angle sensor 14, and the signal processing portion 15 are connected to the controlling portion 12. Respective speaker units 161 to 168 of the speaker array 16 are connected to the signal processing portion 15.

The rotation angle sensor 14 is configured by a rotary encoder, a geomagnetic sensor or the like, and senses a rotation angle of the loudspeaker apparatus 1. The rotation angle sensor 14 outputs a value corresponding to the sensed rotation angle to the controlling portion 12.

The user I/F 11 is configured by operation buttons provided to a main body, a remote controller, or the like, and accepts the user's operation. The user I/F 11 sends an operation signal depending on the user's operation to the controlling portion 12. The user inputs an interior shape of a room (size of a room), distances of the loudspeaker apparatus from the walls, a listening position (relative distance between the listening position and the loudspeaker apparatus), etc., for example. In this case, an inputting screen may be displayed on the television when the loudspeaker apparatus 1 is connected to the television. Also, an inputting screen may be displayed on a FL display (Fluorescent display) of the loudspeaker apparatus 1.

The controlling portion 12 controls the signal processing portion 15 based on a value being input from the user I/F 11 and a value being input from the rotation angle sensor 14, and adjusts the output angles of the sound beams. The signal processing portion 15 applies predetermined delays to the input sound signals respectively in response to the control of the controlling portion 12, and distributes the delayed sound signals to the speaker units 161 to 168 of the speaker array 16. The signal processing portion 15 changes amount of the delays to adjust the output angles of the sound beams, thereby the speaker array 16 can output the sound beams in plural directions. In this embodiment, the loudspeaker apparatus 1 outputs the sound beams as the multi-channel surround sound.

Figure 3A:
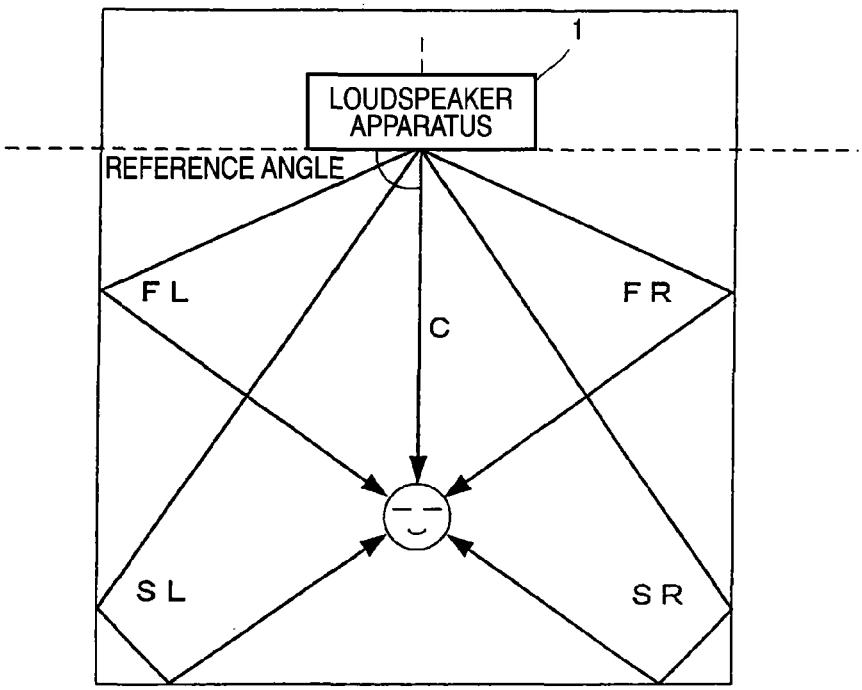
FIGS. 3A and 3B are views showing an example of an output angle adjustment of the sound beams.

FIG. 3 is a view showing an example of an output angle adjustment of the sound beams. A state shown in FIG. 3A is set as a reference state (reference angle) of the loudspeaker apparatus. When the user inputs the interior shape of the room and the set-up position of the loudspeaker apparatus (the distances between the speaker and the walls and the relative distance between the loudspeaker apparatus and the listening position), the controlling portion 12 sets a rotation angle at this point in time as a reference angle, and records this reference angle in the memory 13.

The controlling portion 12 calculates reflection angles of the sound beams from the wall surfaces based on the interior shape of the room and the set-up position of the loudspeaker apparatus, and decides the output angles of the sound beams on all channels. Then, the controlling portion 12 controls amounts of delays in the signal processing portion 15 respectively based on the decided angles, and outputs respective sound beams. In this case, instead of the inputting of numerical values from the user, the distances from the wall surfaces of the interior of the room to the loudspeaker apparatus and a relationship between the listening position and the loudspeaker apparatus may be measured by using the microphone, and then the output angles may be decided. For example, the output angles of a test sound beam at which the levels of the sound picked up by the microphone indicate a peak value respectively are recorded while sweeping the interior of the room with the test sound beam, and the output angles of the test sound beam are set as the output angles of the sound beams respectively. In this case, the reference angle of the speaker array of the loudspeaker apparatus at the time when an input (test sound beam sweeping command) is given through the user I/F 11 is also recorded in the memory 13.

Figure 3B:
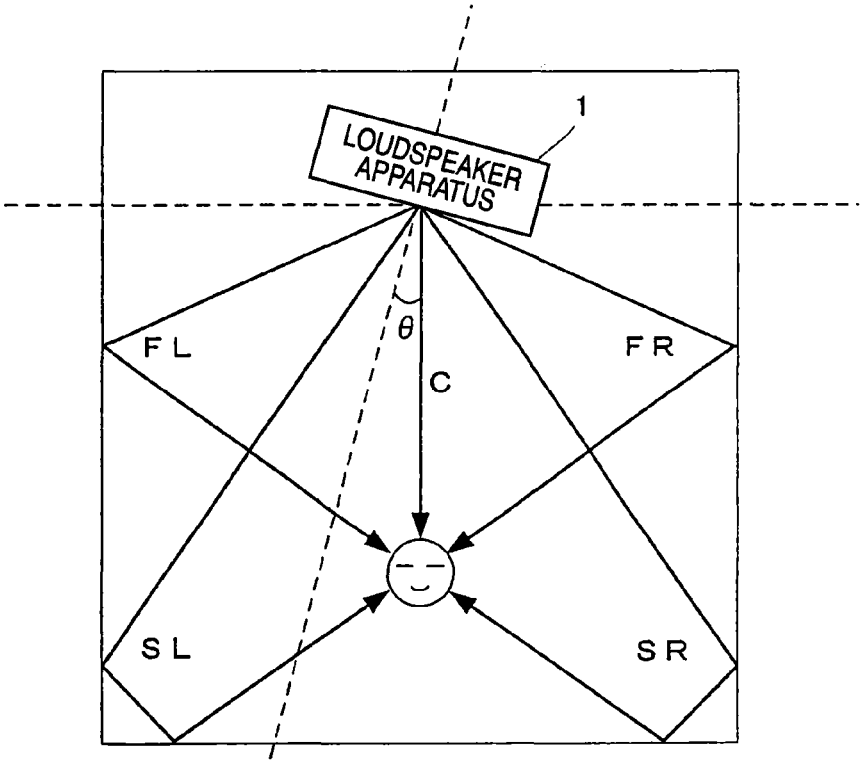

Then, when respective values being input from the rotation angle sensor 14 are displaced from the reference angle, the controlling portion 12 adjusts the output angles of respective sound beams in response to an angle displaced from the reference angle. As a result, as shown in FIG. 3B, respective sound beams reach the listening position.

Figure 4:
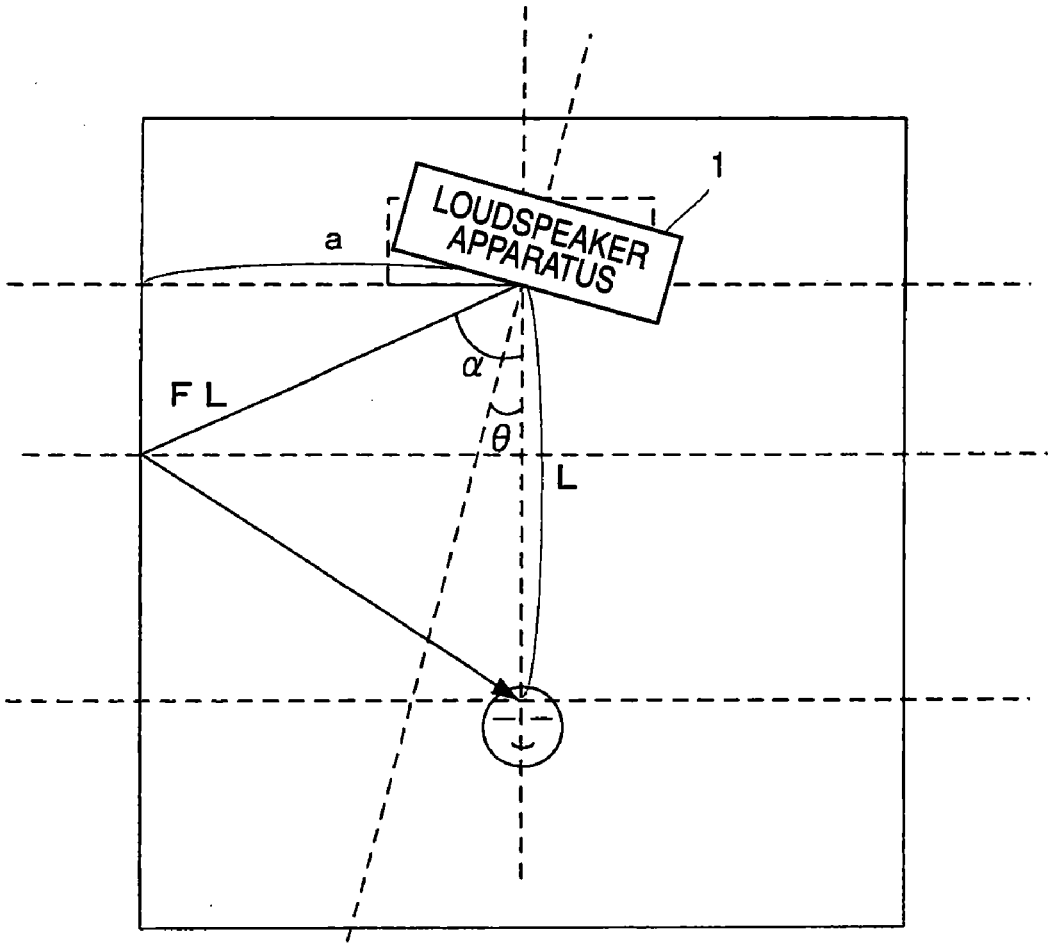
FIG. 4 is a view showing an example of an angle adjusting method.

FIG. 4 is a view showing an example of an angle adjusting method. In FIG. 4, in order to facilitate explanation, only the sound beam on a front L (FL) channel is illustrated. In FIG. 4, $\theta$ denotes an angle change from the reference angle, and $\alpha$ denotes the output angle of the sound beam on the FL channel at a time of the reference angle.

The controlling portion 12 calculates the angle change $\theta$ from the reference angle in response to the value of the angle being input from the rotation angle sensor 14, and calculates the output angle of the sound beam in response to the angle change θ. That is, "the output angle α at a time of the reference angle—the angle change θ" is set as the output angle of the sound beam. After this output angle is set about the sound beams on all channels, the sound beams can be reached the listening position.

As shown in FIG. 5, when the controlling portion 12 records the reference angle at first, the controlling portion 12 calculates in advance amounts of delays at all angle changes respectively and stores these values in the memory 13 as a table format. FIG. 5 is a table showing a relationship between the angle changes and amounts of delay set to each speaker unit. In this case, numerical values shown in FIG. 5 merely indicate an example used in explanation respectively, and do not indicate respective amounts of delay that is set actually in the speaker units.

As shown in FIG. 5, the controlling portion 12 calculates the output angles of the sound beams at a time of the reference angle and calculates amounts of delay set to all speaker units respectively. Also, the controlling portion 12 calculates amounts of delay to all angle changes (in the example in FIG. 5, a resolution is assumed as 5 degree). The controlling portion 12 calculates a table, which shows the relationship between the angle changes and the amounts of the delay, with regard to the sound beams on all channels, and stores the tables in the memory 13 (in FIG. 5, only the front L channel is illustrated). When the loudspeaker apparatus is turned by a rotating angle actually, the controlling portion 12 set the amounts of the delay respectively by reading the table from the memory 13.

Figure 6A:
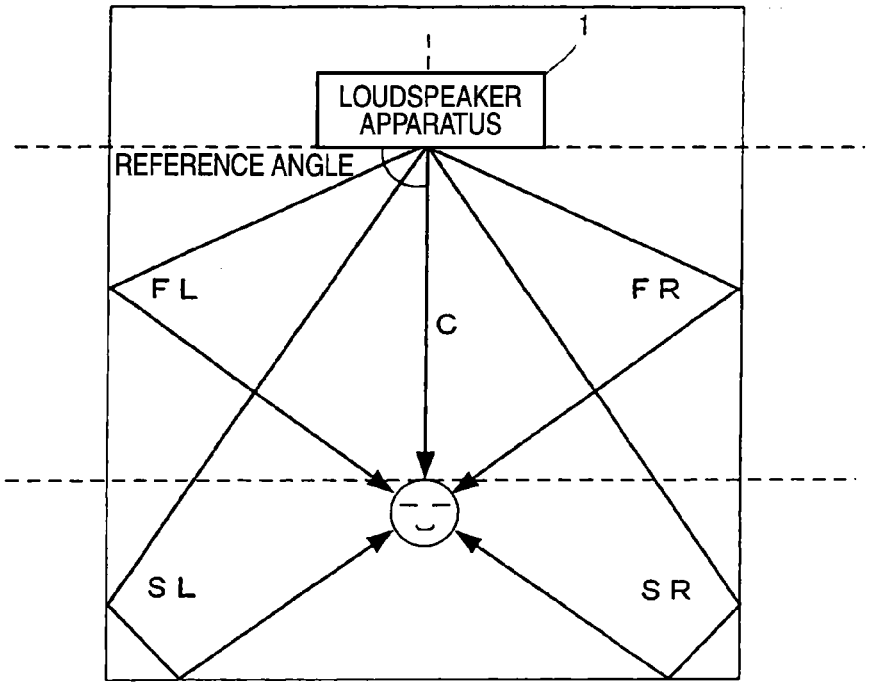
FIGS. 6A and 6B are views showing another example of the output angle adjustment of the sound beams.

FIG. 6 is a view showing another example of the output angle adjustment of the sound beams. A difference from the example shown in FIG. 3 is that, even when the listening position is changed, a relative position (relative distance) between the loudspeaker apparatus and the listening position is not changed. In this example, like the above, the controlling portion 12 also sets the rotation angle shown in FIG. 6A as the reference angle, and stores the rotation angle in the memory 13.

Figure 6B:
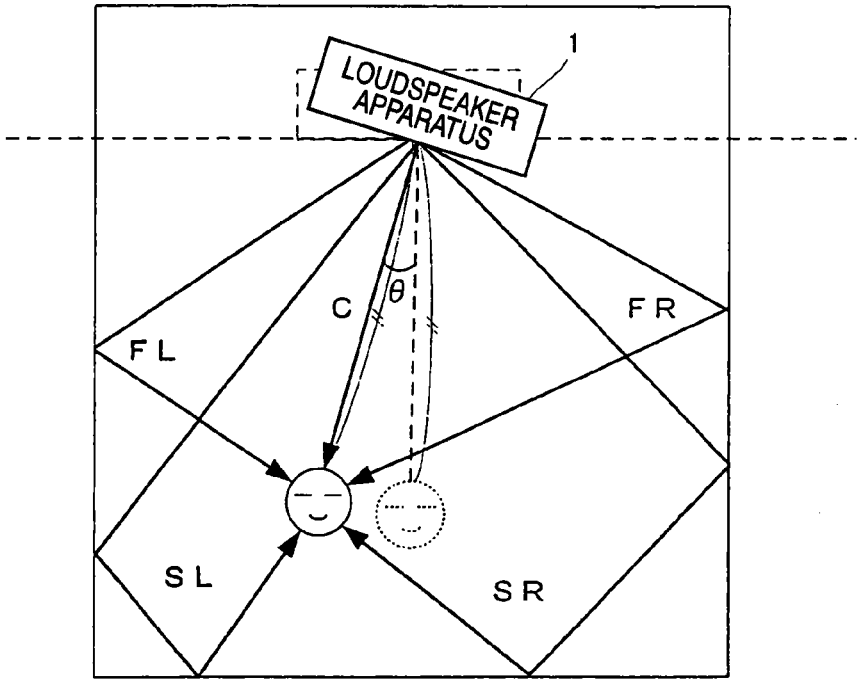

In this example, when the value being input from the rotation angle sensor 14 is displaced from the reference angle, the controlling portion 12 adjusts the output angles of the sound beams in response to an angle displaced from the reference angle. Here, the controlling portion 12 adjusts the output angles by the approach different from that shown in FIG. 4 such that sound beam paths are adjusted as shown in FIG. 6B.

Figure 7:
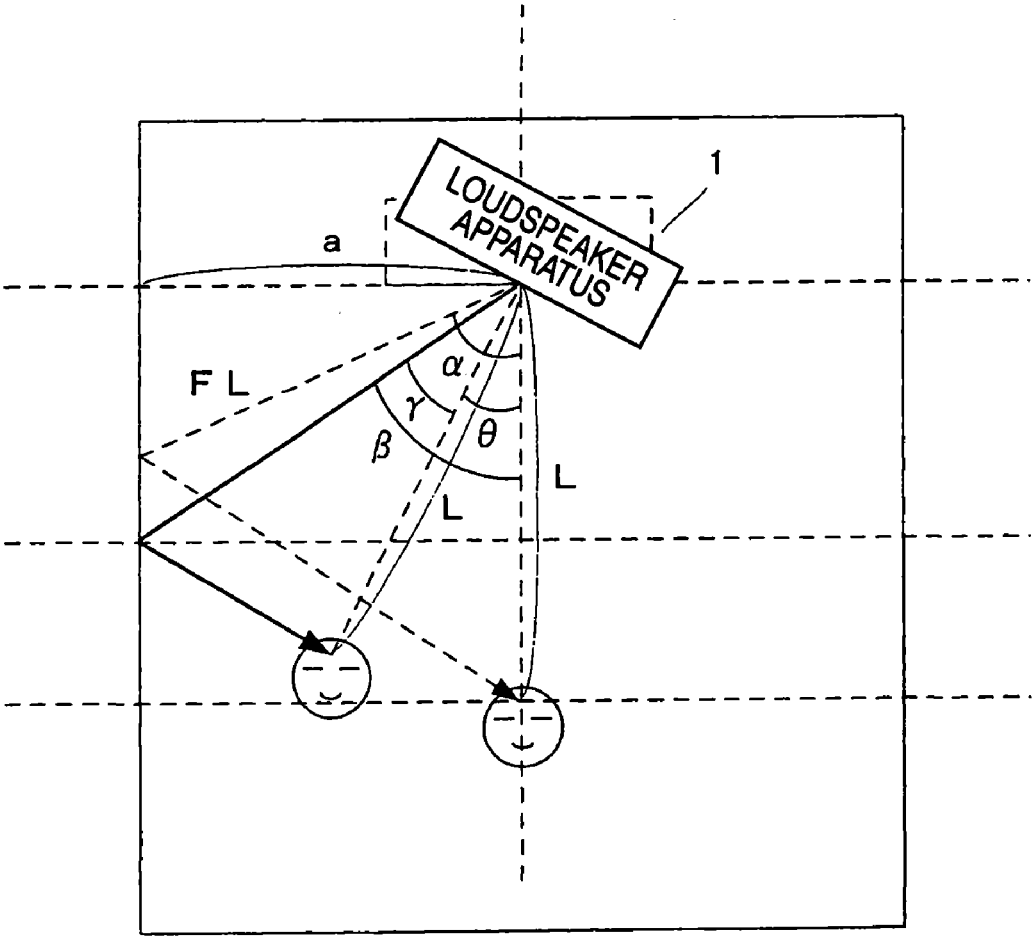
FIG. 7 is a view showing another example of the angle adjusting method.

FIG. 7 is a view showing another example of the angle adjusting method. In FIG. 7, in order to facilitate explanation, only the sound beam on the FL channel is illustrated. In FIG. 7, θ denotes an angle change from the reference angle, and α denotes the output angle of the sound beam on the FL channel at a time of the reference angle, and β denotes a difference between the reference angle and an output angle of the sound beam on the FL channel at a time of the angle θ displaced from the reference angle.

In this case, the controlling portion 12 calculates the output angles on the presumption that a relative distance L between the loudspeaker apparatus and the listening position is not changed. That is, a difference β between the reference angle and the output angle of the sound beam (FL) at the time of the angle θ is given by "$\beta=\tan^{-1}\{(2a-L\sin\theta)/L\cos\theta\}$", where "a" is a width of the interior of the room (distance between the set-up position of the loudspeaker apparatus and the side wall surface of the interior of the room), and "L" is a relative distance between the listening position and the loudspeaker apparatus. Here, the controlling portion 12 calculates an output angle γ ($\gamma=\beta-\theta$) with respect to a new reference angle (front of the loudspeaker apparatus after the angle is changed) in response to the calculated value of the angle difference β, and sets this γ as a new output angle of the sound beam (FL). The controlling portion 12 controls the sound beams so as to reach the listening position by setting this new output angle to the sound beams on all channels. In this event, since the relative distance between the loudspeaker apparatus and the listening position is not changed, the sound beam on a center (C) channel is not changed but the output angles of the sound beams on other channels are adjusted.

Then, the controlling portion 12 switches an adjusting process between an adjustment mode depicted in FIG. 3 and an adjustment mode depicted in FIG. 6 selectively in response to the value of the angle change. For example, the adjustment mode of the output angle shown in FIG. 3 and FIG. 4 is performed when the angle change is within ±5 degree, while the adjustment mode of the output angle shown in FIG. 6 and FIG. 7 is performed when the angle change is in excess of ±5 degree. When the angle change is small, the controlling portion 12 decides such that merely the set-up direction of the loudspeaker apparatus is changed because the user comes in touch with the speaker array, or the like, nevertheless the listening position is not changed (for C example, assume that the user thought that he or she restored the loudspeaker apparatus into the original angle but actually the speaker unit was not restore into the original angle). Therefore, the controlling portion 12 adjusts the output angles of the sound beams on all channels including the center channel, and thus adjusts such that the sound beams reach the listening position. In contrast, when the angle change is large, the controlling portion 12 decides such that, the user changes the listening position and thus the user turns the loudspeaker apparatus toward the front of the user himself or herself (the relative position is not changed). Therefore, the controlling portion 12 adjusts the output angles of the sound beams except the center channel. Also, these adjustment modes may be switched based on the command from the user.

Figure 8A:
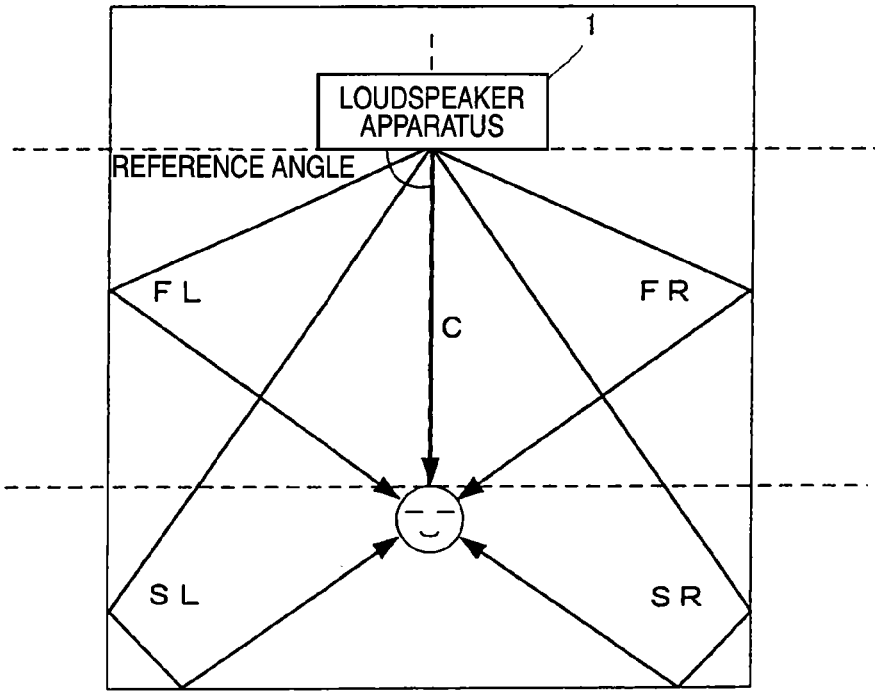
FIGS. 8A and 8B are views showing a variation of the output angle adjustment of the sound beams.
Figure 8B:
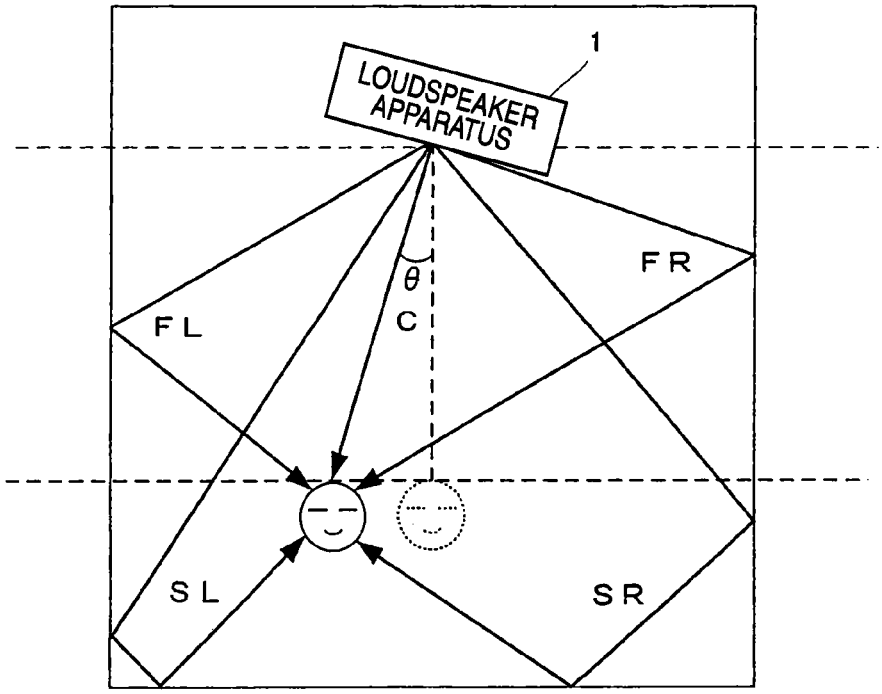

Then, FIG. 8 is a view showing a other example of the output angle adjustment of the sound beams. A difference from the example shown in FIG. 6 is that the listening position is displaced in parallel on a surface of the sheet in the left direction (toward the left wall surface in the interior of the room) and the relative position (relative distance) between the loudspeaker apparatus and the listening position is changed. In this example, like the above, the controlling portion 12 sets the rotation angle shown in FIG. 8A as the reference angle, and stores the rotation angle in the memory 13.

In this example, when the value being input from the rotation angle sensor 14 is displaced from the reference angle, the controlling portion 12 adjusts the output angles of the sound beams in response to the angle change displaced from the reference angle. Here, the controlling portion 12 adjusts the output angles by the approach different from that shown in FIG. 7 such that sound beam paths are adjusted as shown in FIG. 5B.

Figure 9:
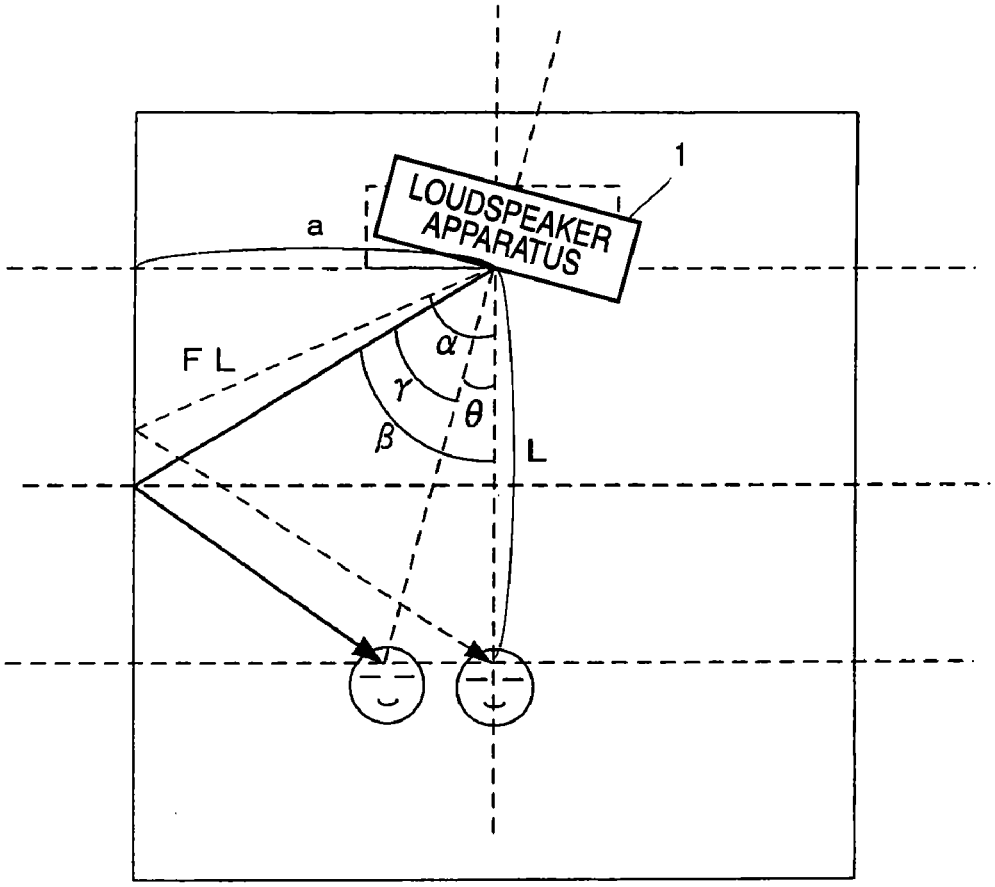
FIG. 9 is a view showing a variation of the angle adjusting method.

FIG. 9 is a view showing other example of the angle adjusting method. In FIG. 9, in order to facilitate explanation, only the sound beam on the FL channel is illustrated. In FIG. 9, θ denotes an angle change from the reference angle, and a denotes the output angle of the sound beam on the FL channel at a time of the reference angle, and β denotes a difference between the reference angle and an output angle of the sound beam on the FL channel at a time of the angle θ displaced from the reference angle.

In this case, the controlling portion 12 calculates the angle change θ from the reference angle in response to the value of the angle being input from the rotation angle sensor 14, and calculates the output angles in response to the shape of the interior of the room and the set-up position of the loudspeaker apparatus. That is, a difference β between the reference angle and the output angle of the sound beam (FL) at the time of the angle θ is given by "$\beta=\tan^{-1}\{(2a-L\sin\theta)/L\}$", where "a" is a width of the interior of the room (distance between the set-up position of the loudspeaker apparatus and the side wall surface of the interior of the room), and "L" is a relative distance between the loudspeaker apparatus and the listening position. Here, the controlling portion 12 calculates an output angle γ ($\gamma=\beta-\theta$) with respect to a new reference angle (front of the loudspeaker apparatus after the angle is changed) in response to the calculated value of the angle difference β, and sets this γ as a new output angle of the sound beam (FL). The controlling portion 12 controls the sound beams so as to reach the listening position by setting this new output angle to the sound beams on all channels. In this event, as to the C channel, the output angle of the sound beam may not be changed and the sound beam may be output as it is. However, since the relative distance is changed, any process may be applied, e.g., the focusing position may be changed to the position that is away from the loudspeaker apparatus, a sound volume is increased, or the like.

Then, the controlling portion 12 switches the adjusting process between the adjustment mode depicted in FIG. 6 and an adjustment mode depicted in FIG. 8 in response to the command from the user. Also, instead of the switching of the adjustment mode, an intermediate value between the γ values obtained from FIG. 7 and FIG. 9 may be calculated as the final output angle respectively. Otherwise, the sound beam may be reached both positions by expanding a beam width. In this event, it is assumed that, when a beam width is expanded, a sound volume should be increased to compensate a reduction in a power.

The calculation of the table shown in FIG. 5 is similarly applied in the example explained in FIG. 6 and FIG. 8. When the loudspeaker apparatus is turned actually, the controlling portion 12 sets an amount of delay by reading the table from the memory 13.

Figure 10:
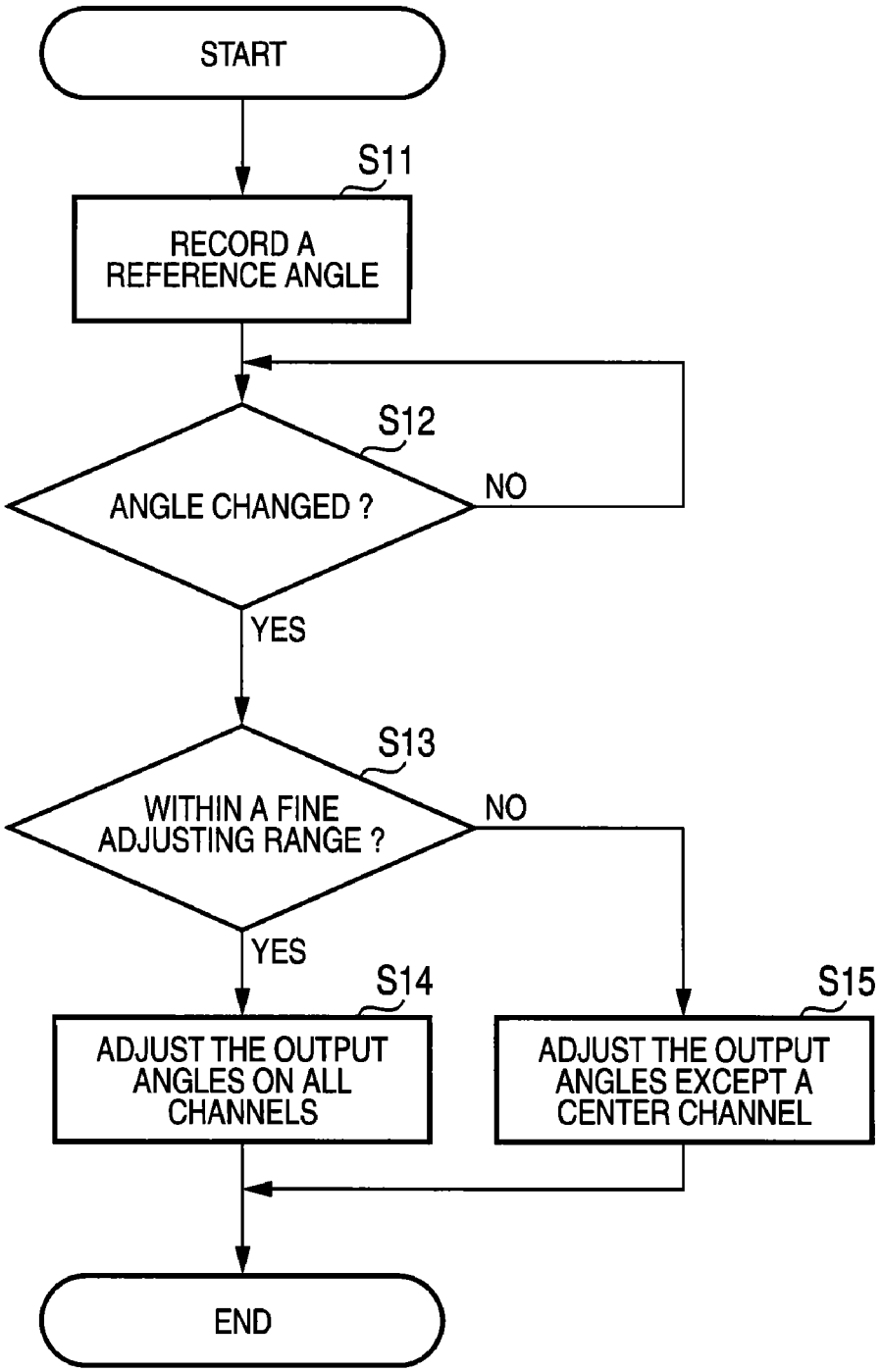
FIG. 10 is a flowchart showing an operation of a controlling portion 12.

Then, FIG. 10 is a flowchart showing an operation of the controlling portion 12. When the user inputs the shape of the room or the set-up position of the loudspeaker apparatus or when the user instructs to make the measurement by using the test sound beam, an operation in FIG. 10 is started.

First, the controlling portion 12 records the value of the rotation angle of a reference surface of the speaker array at that time as the reference angle in the memory 13 (s11). Then, the controlling portion 12 waits until the angle change is detected (s12). If the angle change is detected, the controlling portion 12 decides whether or not the angle change is within a fine adjusting range (within ±5 degree) (s13). If the angle change is within the fine adjusting range (within ±5 degree), the controlling portion 12 adjusts the output angles by the adjustment mode shown in FIG. 3 and FIG. 4, and adjusts the output angles of the sound beams on all channels (s14). If the angle change is out of the fine adjusting range (larger than ±5 degree), the controlling portion 12 adjusts the output angles by the adjustment mode shown in FIG. 6 and FIG. 7 (or FIG. 8 and FIG. 9); and adjusts the output angles except the center channel (s15)

Figure 11A:
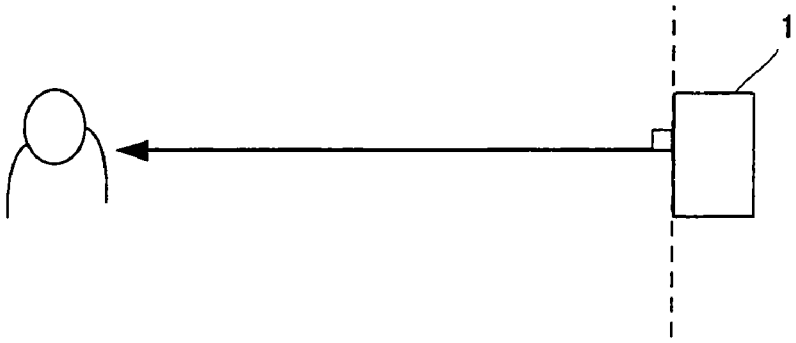
FIGS. 11A and 11B are views showing an angle adjustment in the vertical direction.
Figure 11B:
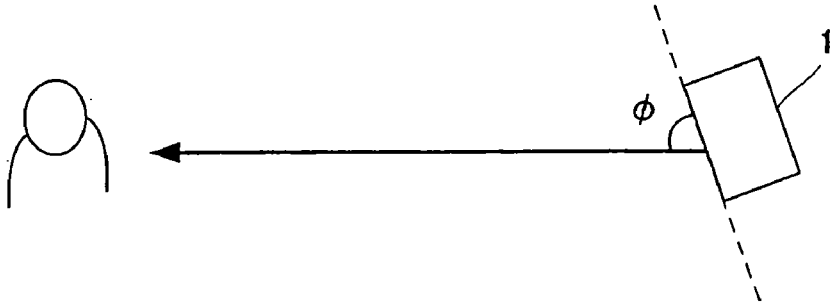

In the above example, the adjustment of the output angle in the horizontal direction is explained. In this case, when the loudspeaker apparatus is mounted to the appliance whose angle is also changed in the vertical direction, e.g., the wall mount of the slim television, or the like, the loudspeaker apparatus may be constructed such that, as shown in FIG. 11, the sound beams are adjusted in the vertical direction. In this case, a sensor for sensing an angle (ϕ in FIG. 11) in the vertical direction is provided in the loudspeaker apparatus.

Figure 12A:
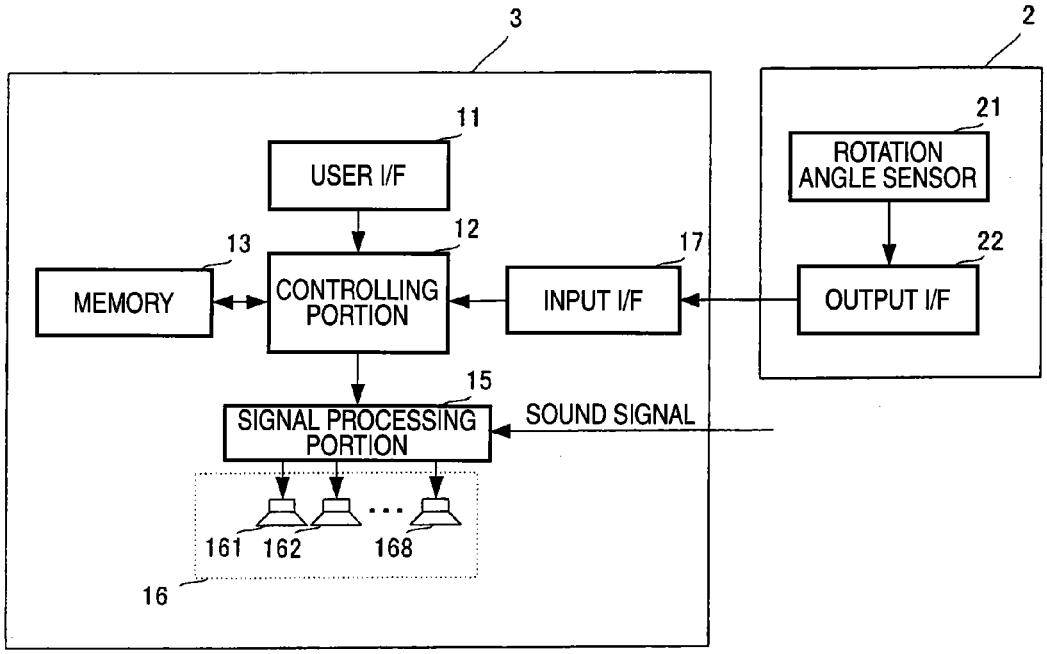
FIG. 12A is a block diagram showing a configuration of a speaker system according to a variation and FIG. 12B is an external view showing an appearance of the speaker system.
Figure 12B:
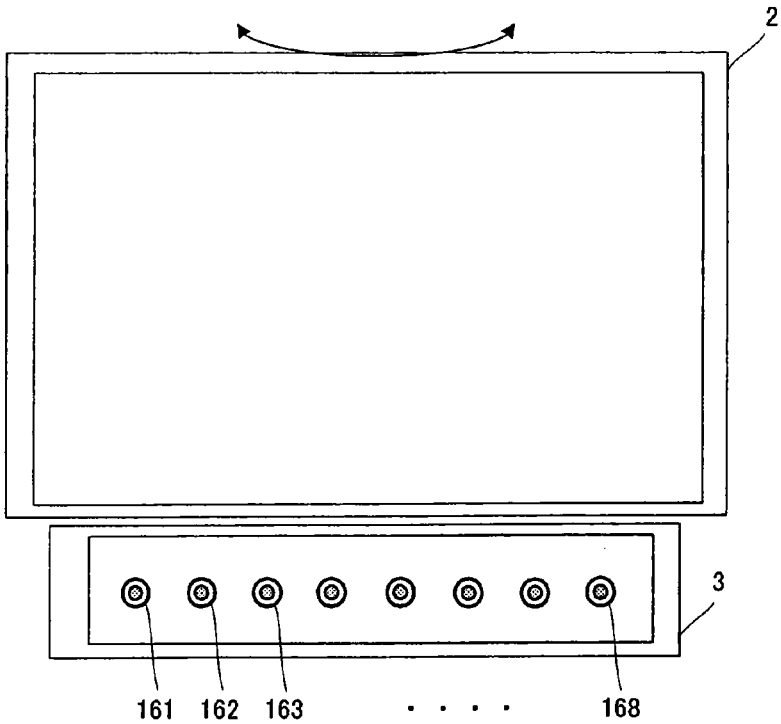

Also, in the present embodiment, a variation described as follows can be applied. FIG. 12A is a block diagram showing a configuration of a speaker system according to the variation, and FIG. 12B is an external view of the same speaker system. Here, the same reference symbols are affixed to the configurations common to those in FIG. 2, and their explanation will be omitted herein.

This speaker system includes a loudspeaker apparatus 3, and a television 2 connected to the loudspeaker apparatus 3. The loudspeaker apparatus 3 and the television 2 are integrated into one unit, and the loudspeaker apparatus 3 is also turned when the television 2 is turned.

The television 2 has a rotation angle sensor 21, and an output I/F 22 that outputs a value of the rotation angle. Also, the loudspeaker apparatus 3 has an input I/F 17 that receives the value of the rotation angle from the output I/F 22. Here, the output I/F 22 and the input I/F 17 may be constructed by the interface based on any standard. For example, the CEC bender command of HDMI (registered trademark) may be employed.

In this speaker system, the rotation angle sensor 21 of the television 2 is used in place of the rotation angle sensor 14 of the loudspeaker apparatus 1 shown in FIG. 2. The operation performed by the controlling portion 12 is similar to that in the flowchart explained in FIG. 10. In this manner, the rotation angle sensor 21 may be provided to the television 2, and the loudspeaker apparatus 3 may adjust the output angles of the sound beams by using the sensed angle change. In this case, when the rotation angle sensor 21 is provided to the television 2, a rotation angle sensor may be not provided to the loudspeaker apparatus 3.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application *No.* 2008-159985 filed on Jun. 19, 2008, the contents of which are incorporated herein for reference.

What is claimed is:

1. A loudspeaker apparatus comprising:

a speaker array that has a sound emitting surface and a plurality of speaker units arranged relative to the sound emitting surface that emits sound beams for a plurality of channels;

an angle sensing section that senses an angle change in the sound emitting surface relative to a set reference angle position of the sound emitting surface; and an adjusting section that adjusts output angles of the sound beams in response to the angle change sensed by the angle sensing section, and wherein the adjusting section adjusts the output angles of the sound beams except a sound beam for a center channel among the sound beams for the plurality of channels.

2. The loudspeaker apparatus according to claim 1, wherein the adjusting section adjusts the output angles of the sound beams in at least one of a horizontal direction or a vertical direction.

3. The loudspeaker apparatus according to claim 1, further comprising:

a storage section that stores information regarding delay amounts of sound signals with respect to angle changes the set reference position of the sound emitting surface, wherein the delay amount corresponding to the angle change sensed by the angle sensing section is read from the storage section, and wherein the adjusting section sets the delay amount read from the storage section to the speaker units to adjust the output angles of the sound beams.

4. The loudspeaker apparatus according to claim 1, wherein an angle of the sound emitting surface at a time of receiving information regarding an interior shape of a room and a set-up position of the loudspeaker apparatus in the room is set as the reference angle position.

5. The loudspeaker apparatus according to claim 1, wherein an angle of the sound emitting surface at a time of measuring a shape of an interior of a room and a relationship between a listening position and the loudspeaker apparatus by sweeping a test sound beam is set as the reference angle position.

6. A loudspeaker apparatus comprising:

a speaker array that has a sound emitting surface and a plurality of speaker units arranged relative to the sound emitting surface that emits sound beams for a plurality of channels;

an angle sensing section that senses an angle change in the sound emitting surface relative to a set reference angle position of the sound emitting surface; and an adjusting section that adjusts output angles of the sound beams in response to the angle change sensed by the angle sensing section, wherein the adjusting section adjusts the output angles of the sound beams for all of the plurality of channels, including the center channel, when the angle change is smaller than a predetermined degree, and wherein the adjusting section adjusts the output angles of the sound beams except the sound beam for the center channel when the angle change exceeds the predetermined degree.

7. A speaker system comprising:

a loudspeaker apparatus; and a display apparatus integrally constructed with the loudspeaker apparatus, wherein the loudspeaker apparatus includes:

a speaker array that has a sound emitting surface and a plurality of speaker units arranged relative to the sound emitting surface that emits sound beams for a plurality of channels;

an angle sensing section that senses an angle change in the sound emitting surface relative to a set reference angle position of the sound emitting surface, provided in at least one of the loudspeaker apparatus or the display apparatus; and an adjusting section that adjusts output angles of the sound beams in response to the angle change sensed by the angle sensing section, wherein the adjusting section adjusts the output angles of the sound beams except a sound beam for a center channel among the sound beams for the plurality of channels.

8. A speaker system comprising:

a loudspeaker apparatus; and a display apparatus integrally constructed with the loudspeaker apparatus, wherein the loudspeaker apparatus includes:

a speaker array that has a sound emitting surface and a plurality of speaker units arranged relative to the sound emitting surface that emits sound beams for a plurality of channels;

an angle sensing section that senses an angle change in the sound emitting surface relative to a set reference angle position of the sound emitting surface, provided in at least one of the loudspeaker apparatus or the display apparatus; and an adjusting section that adjusts output angles of the sound beams in response to the angle change sensed by the angle sensing section, wherein the adjusting section adjusts the output angles of the sound beams for all of the plurality of channels, including the center channel, when the angle change is smaller than a predetermined degree, and wherein the adjusting section adjusts the output angles of the sound beams except the sound beam for the center channel when the angle change exceeds the predetermined degree.

* * * * *